US006827376B2

(12) United States Patent
Fountaine

(10) Patent No.: US 6,827,376 B2
(45) Date of Patent: Dec. 7, 2004

(54) LATCH AND METHOD OF MOUNTING SAME

(75) Inventor: Howard John Fountaine, Wellington (NZ)

(73) Assignee: Assa Abloy Financial Services AB, Stockholm (SE)

( * ) Notice: Subject to any disclaimer, the term of this patent is extended or adjusted under 35 U.S.C. 154(b) by 0 days.

(21) Appl. No.: 10/176,463

(22) Filed: Jun. 18, 2002

(65) Prior Publication Data

US 2002/0195826 A1 Dec. 26, 2002

(30) Foreign Application Priority Data

Jun. 20, 2001 (NZ) ..... 512511

(51) Int. Cl.[7] ..... E05C 19/10
(52) U.S. Cl. ..... 292/98; 292/DIG. 53
(58) Field of Search ..... 292/98, 97, 111, 292/113, 123, 124, 126, 336, DIG. 21, DIG. 46, DIG. 53, DIG. 64, 353

(56) References Cited

U.S. PATENT DOCUMENTS 3,151,901 A * 10/1964 Ahlgren ..... 292/124

* cited by examiner

*Primary Examiner*—Gary Estremsky
(74) *Attorney, Agent, or Firm*—Blakely Sokoloff Taylor & Zafman

(57) ABSTRACT

A latch device intended for use with sliding and hung window systems. The latch device has a body (10) and a latch element (11) which is moveable between a latching position where it projects from the body (10) and a non-latching position where it is retracted into the body. A slide element (15) in a body (14) is coupled to a movable sub-housing (12) so that movement of the sub-housing (12) by the slide element (15) causes the latch element (11) to be moved. The body (10) is insertable into an opening in a window section and snap locks in place by the action of fingers (27) and face plate (18) acting on opposite sides of the window section adjacent the opening. The latch device can thus be fixed into a window section without any additional fasteners.

9 Claims, 7 Drawing Sheets

LATCH AND METHOD OF MOUNTING SAME

BACKGROUND OF THE INVENTION

This invention relates to a latch and method of mounting same. More particularly but not exclusively the latch and method of mounting is intended for use with sliding and hung window systems.

Typically latches for sliding and hung window systems are surface mounted. Thus they are readily visible on the window and can therefore adversely impact on the aesthetic appeal of the window installation.

Surface mounting latches are normally attached to the window by use of mechanical fasteners. In time the latch can become "loose" on the window due to loosing of the mechanical fastener or in extreme cases the opening in the window extrusion in which the fastener is fitted can become oversized and the latch can become separated from the window. Generally this oversizing of the opening results from the fastener initially becoming loose.

SUMMARY OF THE INVENTION

It is an object of the present invention to provide a latch which is in a large part concealed within a window extrusion.

It is a further object of the present invention to provide a latch which is of such construction that no fixing screws or other mechanical fasteners are required for installation of the latch in a window system.

Broadly according to one aspect of the present invention there is provided a latch device including a body, a latch element movably mounted within the body and movable between a latching position and non-latching position, moving mechanism for moving the latch element between said latching and non-latching positions, the body having retaining elements to retain the body when installed through an opening and into a window extrusion.

In a preferred form of the invention the latch device further includes an externally accessible operating slide element which is engageable with said moving mechanism. The slide element can be slidingly engaged with a mounting member which is mountable in a snap lock arrangement in an opening in a window extrusion. The coupling between the slide element and the moving means can be formed by inter-engagement of an elongate member in an aperture.

According to a preferred form of the invention the moving mechanism includes a sub-housing slidingly located in the body, the latch element being pivotal about an axis fixed relative to the body and coupled to the sub-housing such that sliding movement of the sub-housing translates into a pivotal movement of the latch element.

Preferably a biasing means is coupled between the body and the sub-housing. The latch element is preferably a hook tongue.

According to a second broad aspect of the invention there is provided a method of mounting a latch device in an extruded window element the method including the steps of forming apertures in opposing spaced apart walls of the window element, inserting through one aperture in a snap lock fitting a latch body of the latch device so that the body is substantially located within the extruded element and installing in the other aperture operating furniture which when installed inter-engages with latch moving means of the latch body.

BRIEF DESCRIPTION OF THE DRAWINGS

In the following more detailed description of a preferred embodiment of the invention reference will be made to the accompanying drawings in which.

DESCRIPTION OF THE PREFERRED EMBODIMENTS

Figure 1:
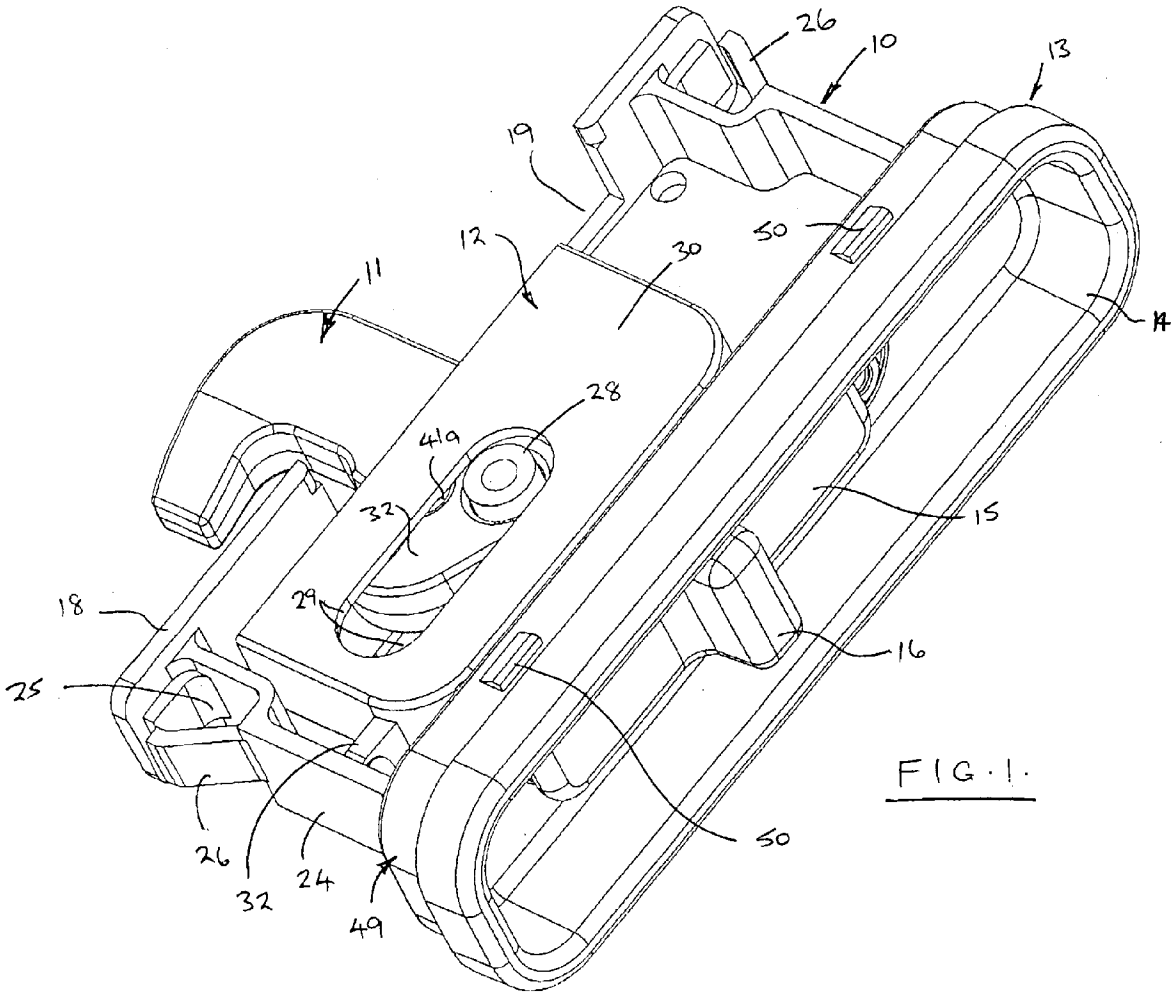
FIG. 1 is a perspective illustration of the latch when in the "locked" position and with a cover of the housing removed for better illustration.

The latch according to the preferred embodiment shown in the drawings includes a main housing 10, a lock beak 11, a sub-housing 12 and operating furniture 13. The operating furniture 13 includes a body 14 and a slide 15 with an integral gripping projection 16. These elements of the construction of the latch are shown in FIG. 1 where a cover 17 (see FIG. 2) of the housing 10 has been removed for the purposes of illustration.

The housing 10 has an integral faceplate 18 with an opening 19 through which the hook beak can move from its retracted (unlatched) position to the projecting (latched or locked) position.

Disposed parallel to but spaced from faceplate 18 is a wall 20 which like faceplate 18 extends at right angles to the floor 23 of the housing 10. This wall 20 also has an opening 21 through which projects a stub shaft 22 from sub-housing 12. The slot 21 is of sufficient length to accommodate the movement of the stub shaft 22 during sliding movement of the sub-housing 12 in housing 10 as will hereinafter be described.

Extending between cover plate 18 and walls 20 and also at right angles to the floor 23 are end walls 24. These end walls 24 kink inwardly toward the faceplate 18 to form a recess 25. A resilient arm 26 extending from wall 24 is located adjacent each recess 25. The arm 26, which is integrally formed with wall 24, extends outwardly at an angle to the plane of wall 24 and is slightly cranked at its distal end 27.

Projecting from the floor 23 of the housing 10 is a spigot 28. This spigot extends through a pair of aligned slots 29 in the respective spaced apart and parallel walls 30 of the sub-housing 12. The hook beak 11 has an opening 31 in the main body 32 thereof and this is journal onto spigot 28. The hook beak 11 can thus rotate about the axis of the spigot 28.

Coupled to a flange 33 extending from an end wall 34 of the sub-housing 12 is a spring 35. The other end of the spring 35 is coupled to a pin 36 which is mounted with the housing 10 by projecting upwardly from floor 23.

The sub-housing 12 is aligned for longitudinal sliding movement within the main housing 10 by an abutment 37 which extends inwardly from the inside surface of wall 20. This abutment 37 engages with the sidewall 38 of sub-housing 12. A plurality of projections 39 extend from one of the walls 30 of the sub-housing 12 and slidingly engage with the inside surface of faceplate 18. Accordingly, when the cover 17 is in place the sub-housing 12 can slidingly move within the housing 10 between the positions shown in FIGS. 3 and 4 which correspond with the latching position and in the unlatched position.

Figure 2:
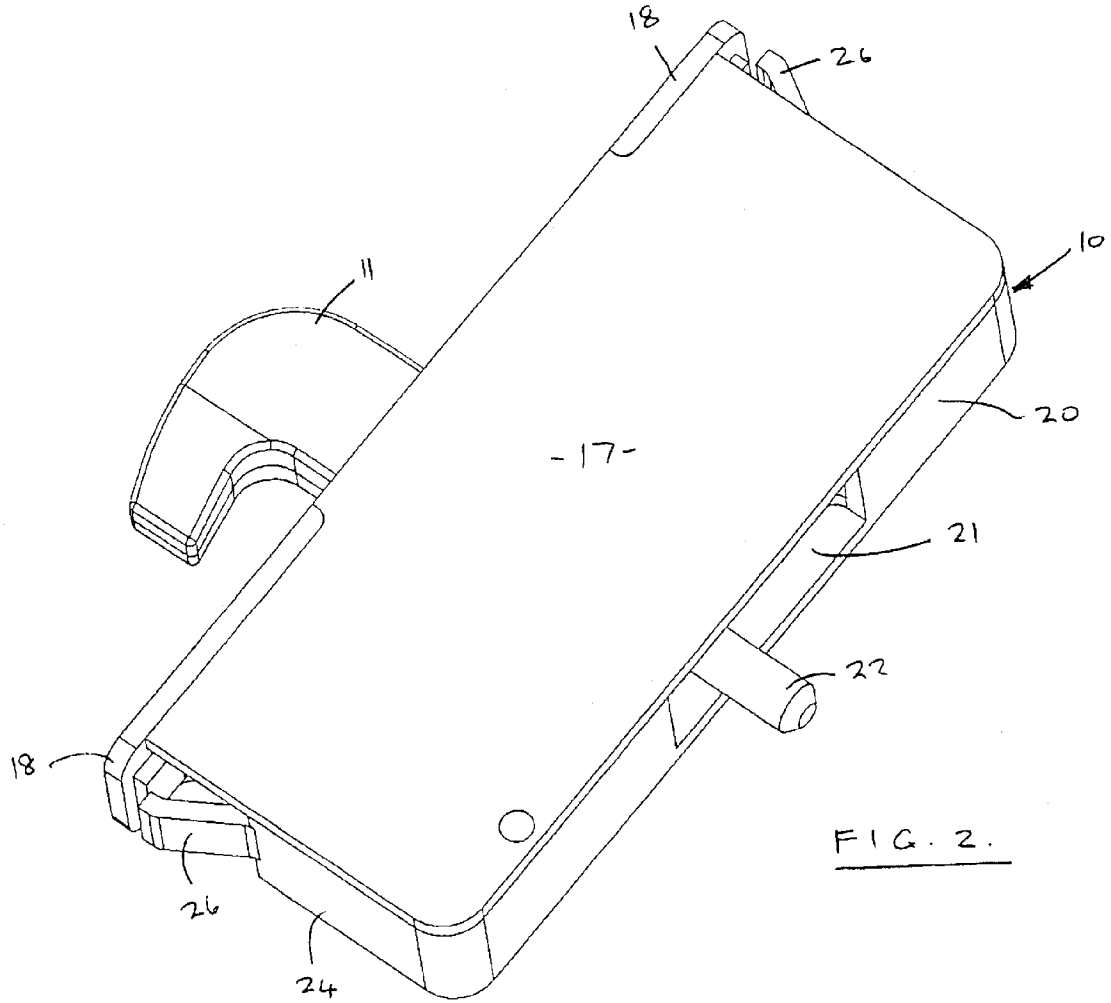
FIG. 2 is a further perspective view of the latch as shown in FIG. 1 but with the cover installed and without the operating "furniture"
Figure 3:
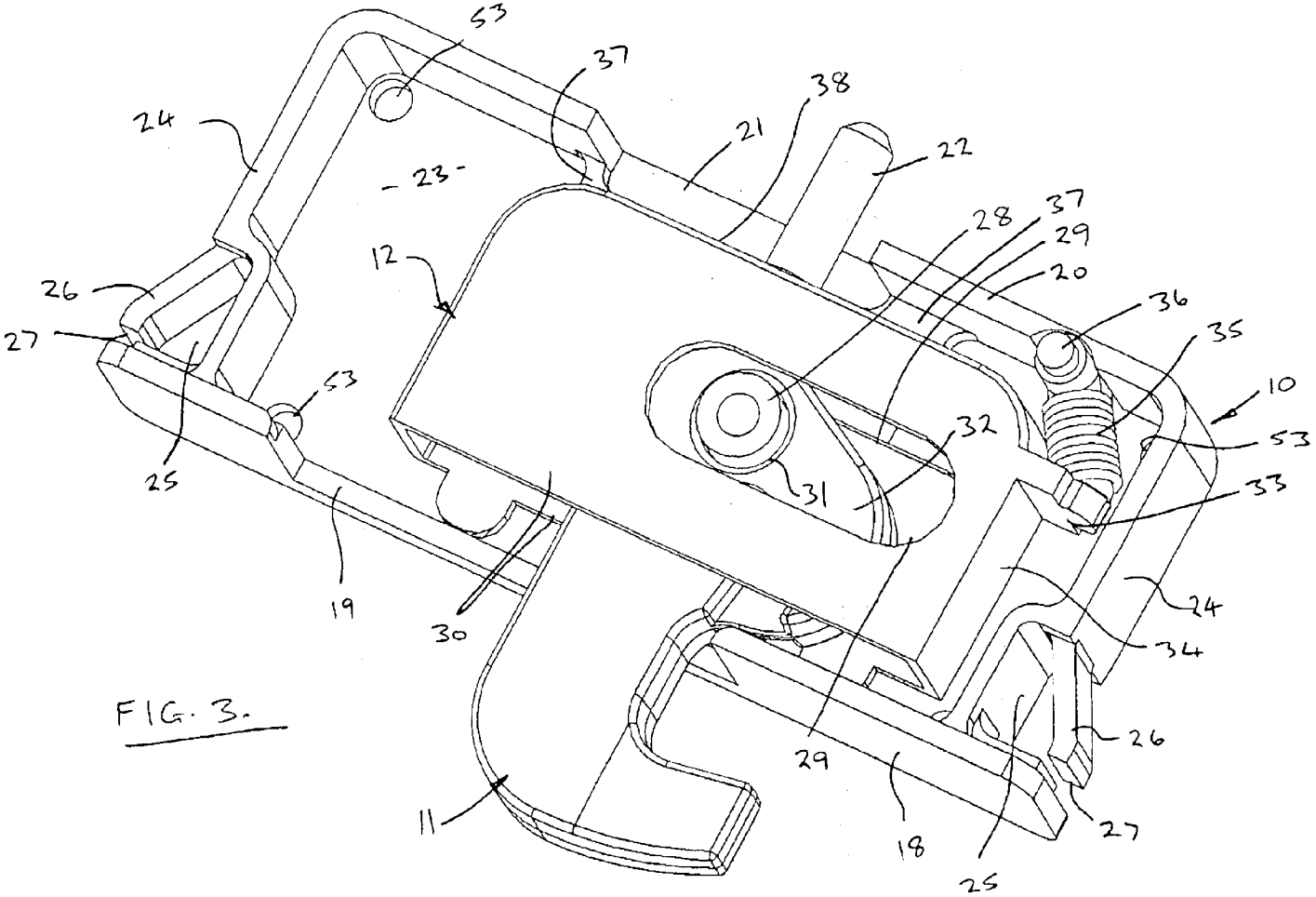
FIG. 3 is a further perspective view of the arrangement shown in FIG. 2 but with the cover removed.

Extending from each of the walls 30 are a pair of oppositely disposed spigots 40. These slidingly engage in a slot 41 formed in the main body 32 of the hook beak 11. The slot 41 has an angled end 41*a*. It is in this end 41*a* that the spigot 40 resides when the hook beak 11 is in the latched position as shown in FIGS. 1–3.

Figure 4:
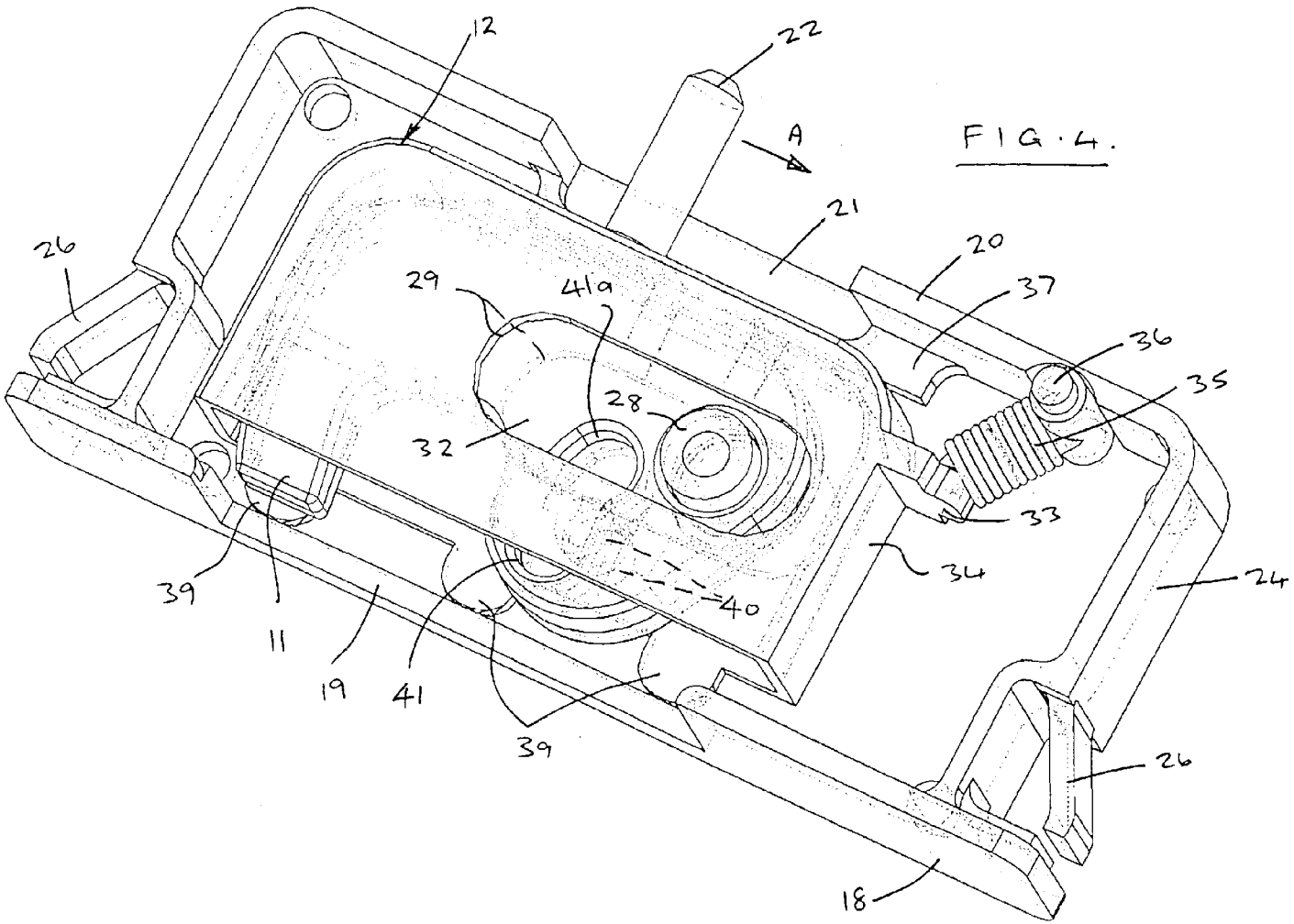
FIG. 4 is a view similar to FIG. 3 but with the latch in the unlocked position.
Figure 5:
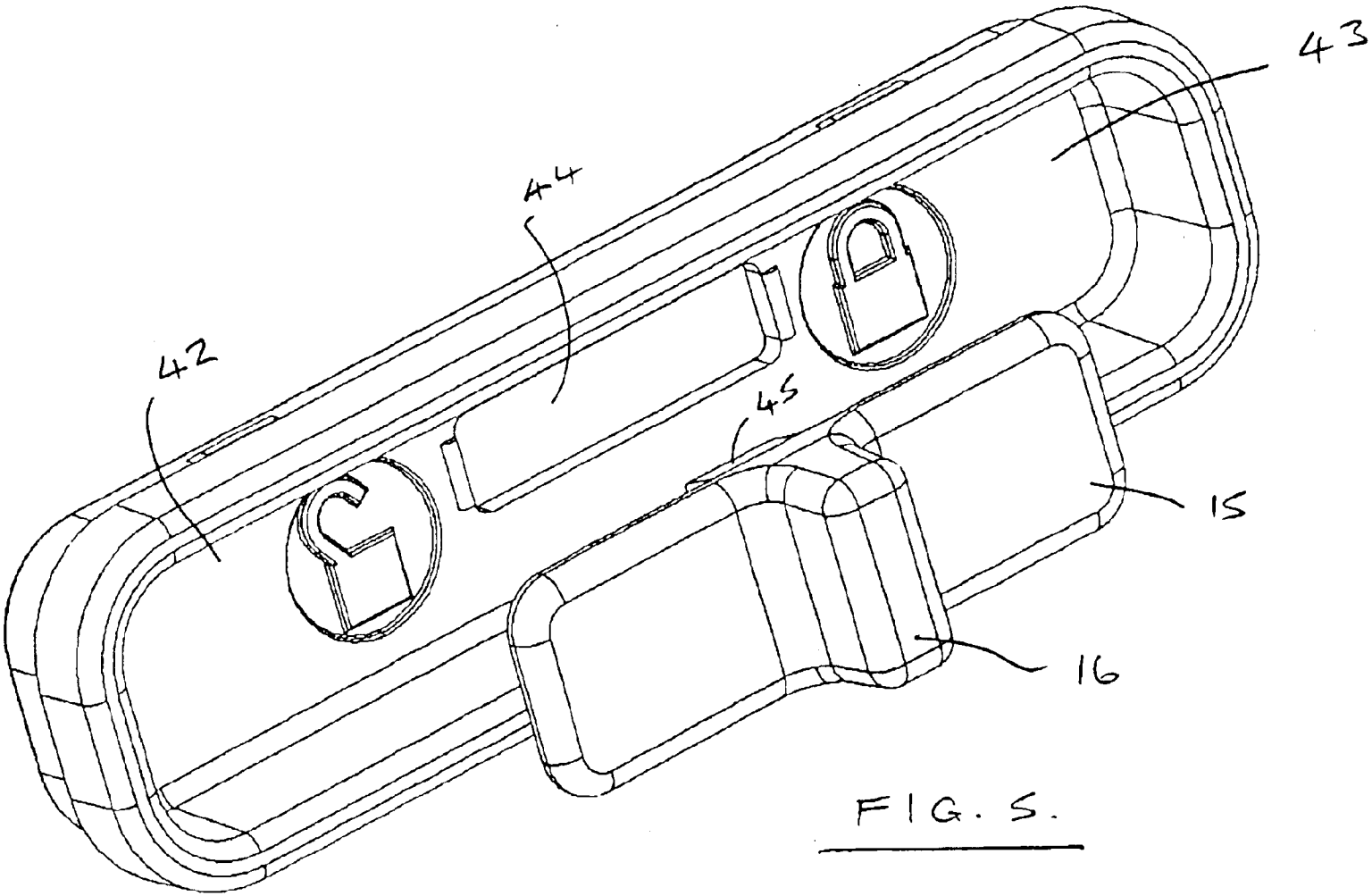
FIG. 5 is a perspective view in disassembled form of the operating furniture.
Figure 6:
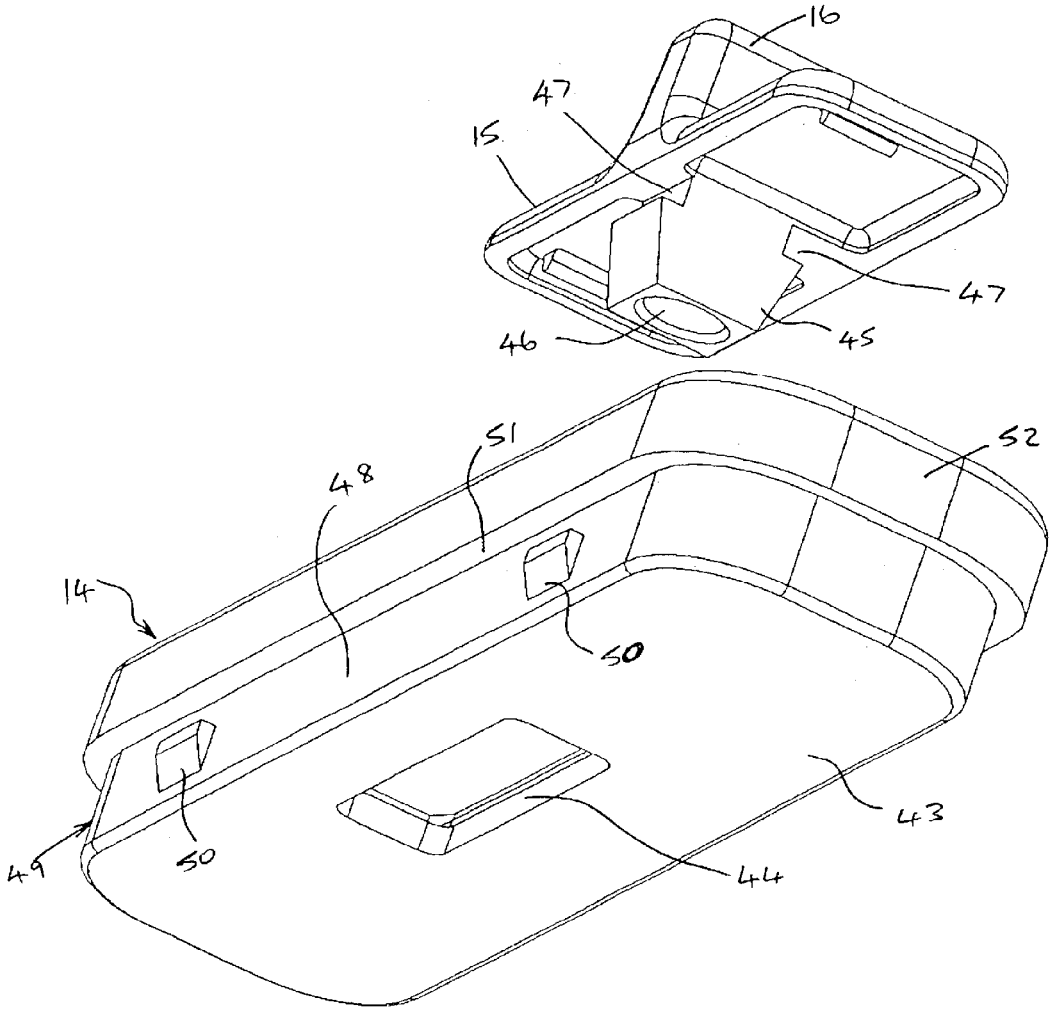
FIG. 6 is a further perspective view of the disassembled operating furniture.
Figure 9:
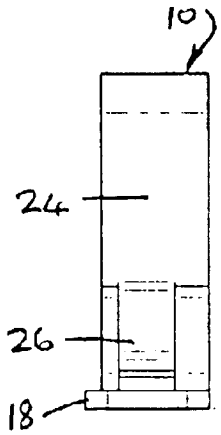
FIG. 9 is an end elevation view of the housing shown in FIGS. 7 and 8.
Figure 8:
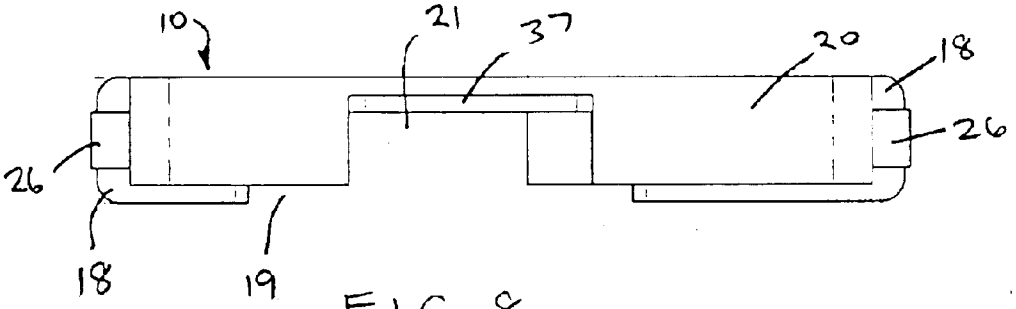
FIG. 8 is a face elevation view of the housing shown in FIG. 7.
Figure 7:
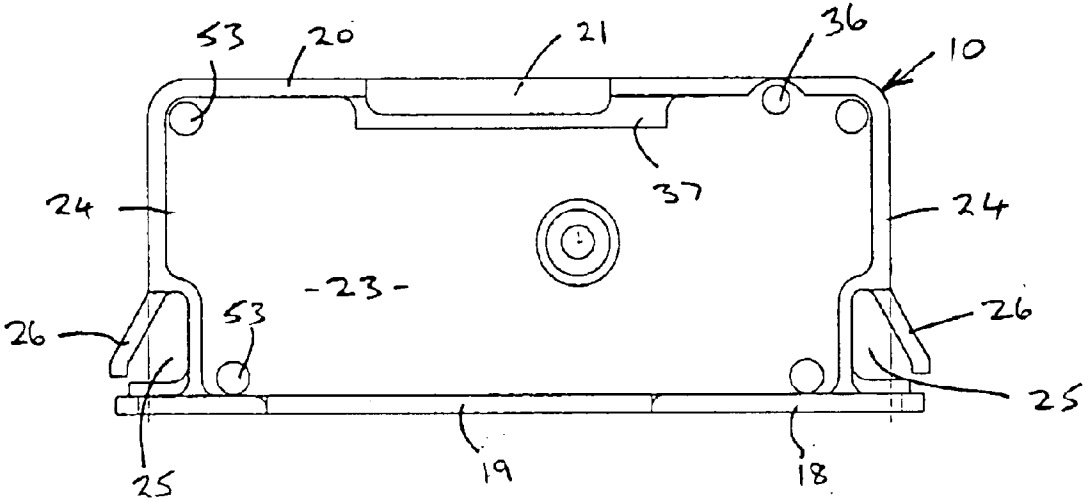
FIG. 7 is a plan view of the housing of the latch.

Referring to FIG. 4 the latch is moved from the unlatched position to the latched position by moving sub-shaft 22 in the direction of arrow A. This causes the sub-housing 12 to slide within the housing 10. This sliding movement results in the spigots 40 sliding along slot 41 which causes the hook beak 11 to rotate about the axis of spigot 28. At the end of the travel the spigots 40 move into portion 41*a* of the slot.

Because end portion 41*a* is not aligned with the main length of the slot 41 it is not possible for someone wishing to gain unauthorised access to manipulate the tongue in such a way as to apply a force which would cause the hook beak to rotate about the axis of spigot 28. Consequently, there is an inbuilt dead latching function achieved when the sub-housing 12 has moved to its fullest extent in the latching direction A. This means that the hook beak 11 when in the deadlocked position can only be moved by moving the stub shaft 22 in a direction opposition to arrow A i.e. toward the unlatching position.

It will be noted that the spring 35 applies a spring bias to the sub-housing 12 when in the unlatched position. This ensures that the hook beak 11 remains in the retracted position.

The operating furniture consists of a body 11 which forms a recessed area in which the slide 15 is movable. The floor 43 of the recessed area 42 includes an elongate slot 44.

Projecting from the underside of slide 15 is a tapered projection 45 which has a bore or opening 46 within which the end of the stub shaft 22 can engage. Where the tapered projection 45 extends from the main body of the slide 15 a pair of opposed slots 47 are formed. Thus to assemble the slide 15 with the body 14 the tapered projection 45 is forced through slot 44 until the long edges of the slot 44 slidingly engage in slots 47. Therefore, effectively slide 15 is fitted in a "snap lock" fitting arrangement with body 14.

On the external of the surfaces of the long walls 48 of wall 49 are a pair of spaced apart ramps 50. The ramps 50 are spaced from the shoulder 51 formed by rim 52 of the body 14. The spacing is about the same as the thickness of material surrounding a shaped opening formed in the window extrusion into which the well 49 is inserted during installation of the latch. Thus, once again a snap-lock fitting is used when installing the body 14 in the opening formed in the window extrusion.

Similarly, an opening is formed in the window extrusion opposite that in which the body 14 of the operating furniture is inserted. This opening is sized so as to accommodate the length and height of the body 10 but is less than the overall dimensions of the faceplate 18. The body 10 is thus inserted through this opening and as it does so the fingers 26 move resiliently into the recesses 25 but spring back when the housing is pushed fully home into the window extrusion thereby capturing the housing 10 within the extrusion. Generally the housing 10 will be installed in the window extrusion before the operating furniture so that the slide 15 can be correctly aligned for engagement of the sub-shaft 22 through opening 46 in the tapered projection 45.

No fixing screws are therefore required in either assembly of the latch or its installation. As described above the operating furniture and the latch body 10 are simply snap-locked into place in the window extrusion. This results in the mechanism of the latch essentially being located within the window extrusion while the only visible feature will be the rim portion and slide within the recess 43 visible. However, these features can, as illustrated in the drawings, be made aesthetically pleasing in appearance and will, therefore, not detract from the visual appearance of the window.

Likewise, the latch itself can be assembled without the need for any fixing screws. By slightly parting the walls 30 of the sub-housing 12 sufficient clearances is provided for insulation of the hook beak 11. Upon release of the walls 30 the spigots 40 engage from either side into slot 41. The sub-housing 12 with installed hook beak 11 can then be placed in the housing so that the opening 31 in the hook beak body 32 engages over spigot 28. Once the spring 36 has been installed the cover 17 can be positioned and put in place and retained by say dowels formed integrally with the cover 17 interference fitting in openings 53 in the floor 23 of the housing 10.

The present invention thus provides a latch for sliding and hung window systems. The main latch mechanism is concealed within the window extrusion and fits in a snap-lock type fitting. Likewise, the operating furniture is in part recessed into the window extrusion and snap-locks in place. The only readily visible part of the overall latch assembly can, therefore, be made unobtrusive and aesthetically pleasing in appearance.

What is claimed is:

1. A latch device including a body, a latch element moveably mounted within the body and moveable between a latching position and a non-latching position, a moving mechanism for moving the latch element between said latching and non-latching positions, the body having retaining means to retain the body when installed through an opening and into a window extrusion, a cover plate overhanging each of a pair of opposed side walls of the body, each side wall carrying a spring clip element which has a distal end which locates opposite but spaced from the overhang of the cover plate, a slide element slidingly engaged with a mounting body, the mounting body having a plurality of lugs whereby the mounting body can be snap lock mounted into an aperture in a window extrusion, said aperture being oppositely disposed to said opening, the slide element and the moving mechanism having coupling means whereby the slide element and moving mechanism become coupled when said body and mounting body are engaged in the respective opening and aperture in a window extrusion.

2. A latch device as claimed in claim 1 wherein the coupling means is a bore in the slide element and a projection from the moving mechanism said projection being configured to fit into said bore.

3. A latch device including a body, the body having retaining elements to retain the body when installed through an opening and into a window extrusion, a latch element movably mounted within the body and moveable between a latching position and a non-latching position, a moving mechanism including a sub-housing slidingly located in the body, the latch element being pivotal about an axis fixed relative to the body and coupled to the sub-housing such that sliding movement of the sub-housing translates into a pivotal movement of the latch element for moving the latch element between said latching and non-latching positions, further including an externally accessible operating slide element which is engageable with said moving mechanism, said slide element being slidingly engaged with a mounting member which is mountable in a snap lock arrangement in an opening in a window extrusion.

4. A latch device as claimed in claim 3 wherein coupling of a slide element to the moving mechanism is formed by inter-engagement of an elongate member in an aperture.

5. A latch device as claimed in claim 3 wherein the sub-housing includes an elongate projection which is engageable in a bore in the slide element.

6. A latch device as claimed in claim 5 wherein the elongate projection extends through an elongate opening in the body.

7. A latch device as claimed in claim 3 wherein the latch element is hook shaped and is projectable and retractable through an elongate aperture in the body.

8. A latch device as claimed in claim 7 wherein the latch element is mounted on a spigot fixed to the body, said spigot extending through an elongated slot in the sub-housing.

9. A latch device as claimed in claim 8 further including a biasing spring engaged between the body and the sub-housing to apply a biasing force to sub-housing so that latch element is retained in the retracted position.

* * * * *